US007594683B2

(12) United States Patent
Drzewiecki

(10) Patent No.: US 7,594,683 B2
(45) Date of Patent: Sep. 29, 2009

(54) PIPE ELEVATOR WITH ROTATING DOOR

(75) Inventor: Lopek Drzewiecki, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 337 days.

(21) Appl. No.: 10/907,716

(22) Filed: Apr. 13, 2005

(65) Prior Publication Data

US 2006/0231344 A1 Oct. 19, 2006

(51) Int. Cl.
*E21B 19/06* (2006.01)

(52) U.S. Cl. ..... 294/91

(58) Field of Classification Search ..... 294/91, 294/103.1, 86.1, 86.12, 90, 102.2; 81/57.15, 81/57.16, 57.34; 166/77.52, 77.53, 380; 24/135 N, 278

See application file for complete search history.

(56) References Cited

U.S. PATENT DOCUMENTS 1,495,394 A 5/1924 Bergsten
1,541,986 A 6/1925 Martin
1,564,977 A 12/1925 Schlinger
2,153,474 A * 4/1939 Naylor et al. ..... 294/91
2,211,916 A 8/1940 Krell
4,826,376 A * 5/1989 Aldridge et al. ..... 411/237
2006/0207768 A1 * 9/2006 Angman et al. ..... 166/380

OTHER PUBLICATIONS

European Search Report for Appl. No. 06252021.8 dated Aug. 7, 2006; (6 p.).

* cited by examiner

*Primary Examiner*—Paul T Chin
(74) *Attorney, Agent, or Firm*—Conley Rose, P.C.

(57) ABSTRACT

An elevator comprising a body having a longitudinal axis therethrough. The body is operable to at least partially surround and support a tubular member aligned with the longitudinal axis. The body also has a longitudinal opening that is sized so as to allow the tubular member to pass therethrough. A door is rotatable about the longitudinal axis of the body and has a closed position wherein the tubular member is retained within the body and an opened position wherein the tubular member can pass through the longitudinal opening.

13 Claims, 3 Drawing Sheets

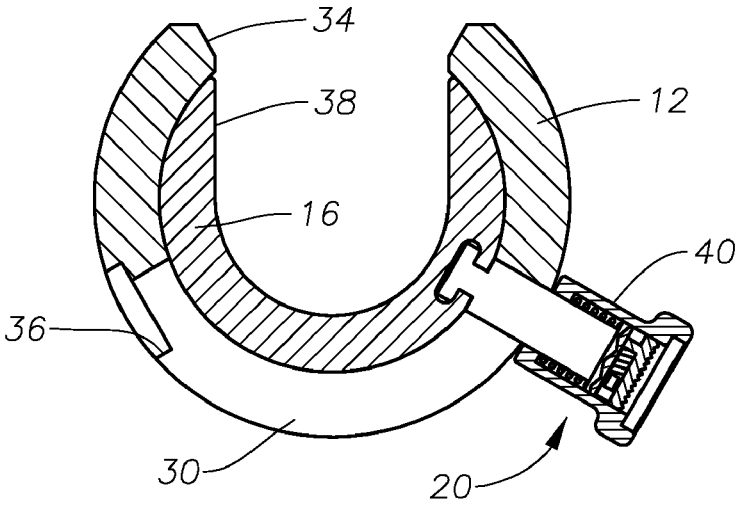
Fig. 3
Fig. 5
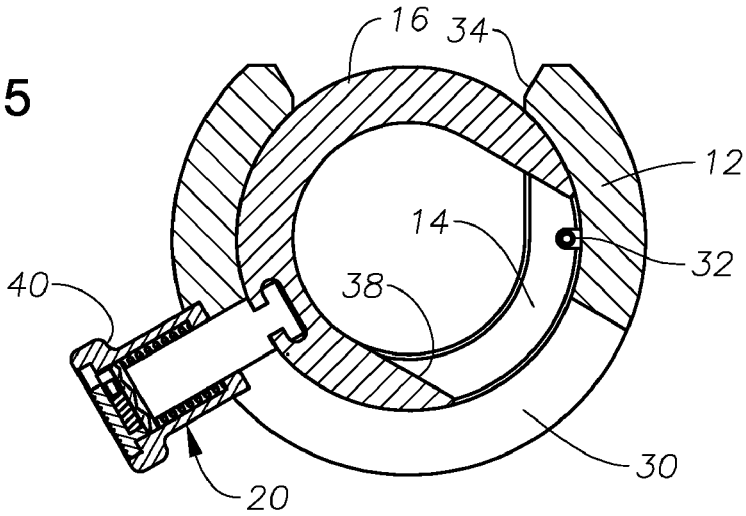
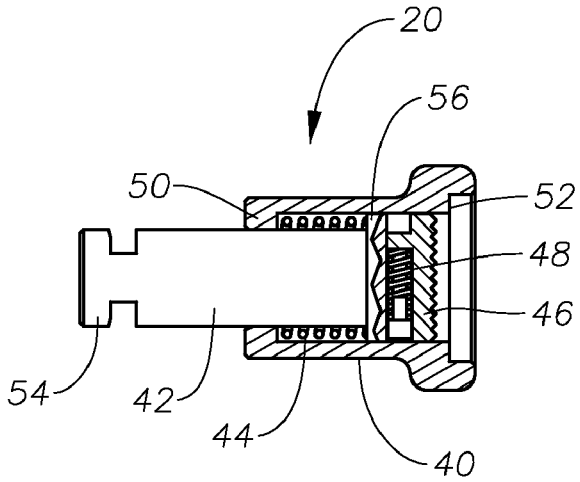
Fig. 4
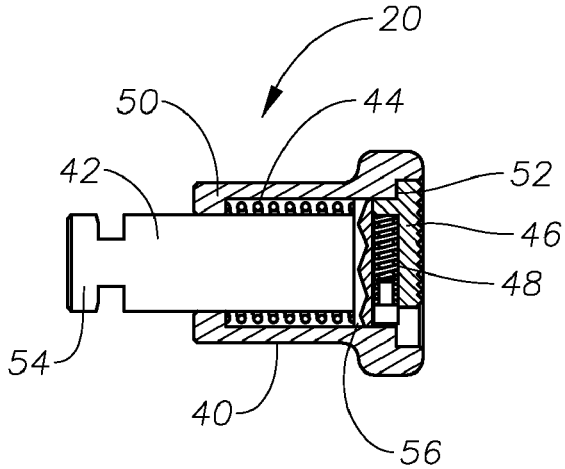
Fig. 6

PIPE ELEVATOR WITH ROTATING DOOR

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

The present invention relates generally to equipment for handing pipe in an oilfield environment. More particularly, the present invention relates to elevators used to engage and lift vertically oriented tubular members.

Many different types of tubular members are handled during drilling, completion, and workover of wells. Among the tubular members used in well construction and servicing are drill pipe, drill collars, casing and tubing. Many different specialized types of equipment are used in handling tubular members during various phases of the drilling, completion, and workover processes.

Elevators are often used when handling tubular members when the tubular members are in or being moved to a vertical, or close to vertical, orientation. Most elevators are configured to interface with a shoulder, or upset, on the outer surface of the tubular member. The engagement of the elevator with this shoulder allows the elevator to support the weight of the tubular member and prevents the tubular member from falling through the elevator.

Many elevators are equipped with swinging doors that open to allow the tubular member to be received in the elevator and are then secured in a closed position to retain the member. These doors are often characterized by hinges that support the swinging doors and lock assemblies that keep the doors closed. These doors and lock assemblies are often manually operated and have thus been a focus of efforts to improve the safety and operation of these devices.

There remains a need to develop methods and apparatus for pipe elevators that overcome some of the foregoing difficulties while providing more advantageous overall results.

SUMMARY OF THE PREFERRED EMBODIMENTS

The embodiments of the present invention are directed toward an elevator comprising a body having a longitudinal axis therethrough. The body is operable to at least partially surround and support a tubular member aligned with the longitudinal axis. The body also has a longitudinal opening that is sized so as to allow the tubular member to pass therethrough. A door is rotatable about the longitudinal axis of the body and has a closed position wherein the tubular member is retained within the body and an opened position wherein the tubular member can pass through the longitudinal opening.

Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein:

FIG. 3 shows a partial sectional view of an open elevator constructed in accordance with embodiments of the invention;

FIG. 4 shows a cross-section view of the locking pin of the elevator of FIG. 3;

FIG. 5 shows a partial sectional view of a closed elevator constructed in accordance with embodiments of the invention;

FIG. 6 shows a cross-section view of the locking pin of the elevator of FIG. 5;

DETAILED DESCRIPTION OF THE PREFERRED EMBODIMENTS

Figure 1:
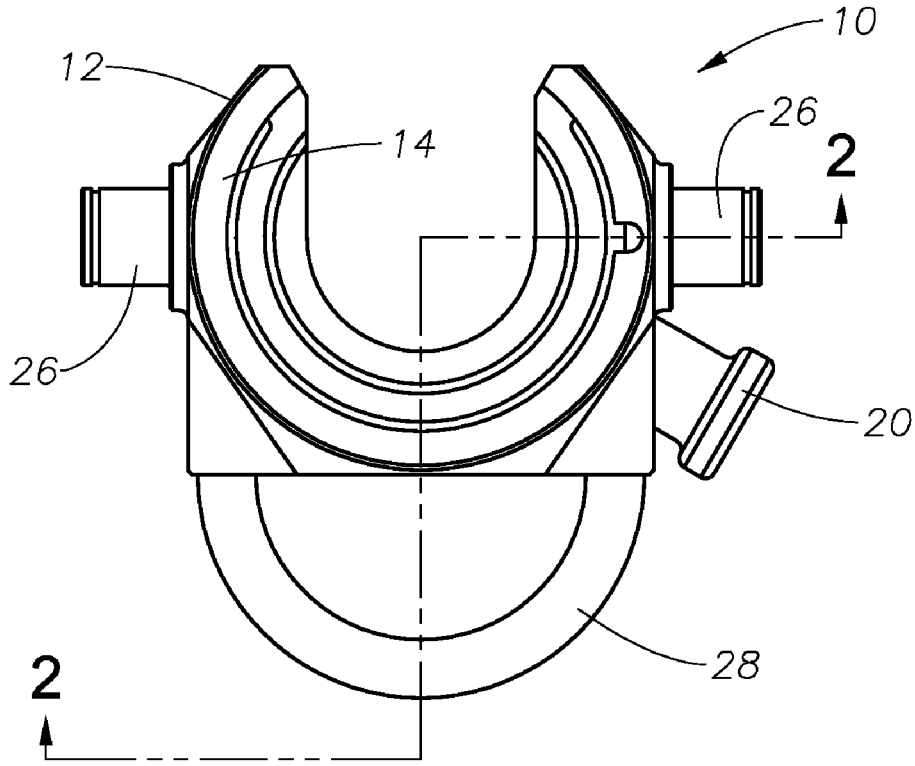
FIG. 1 shows a top view of an elevator constructed in accordance with embodiments of the invention.
Figure 2:
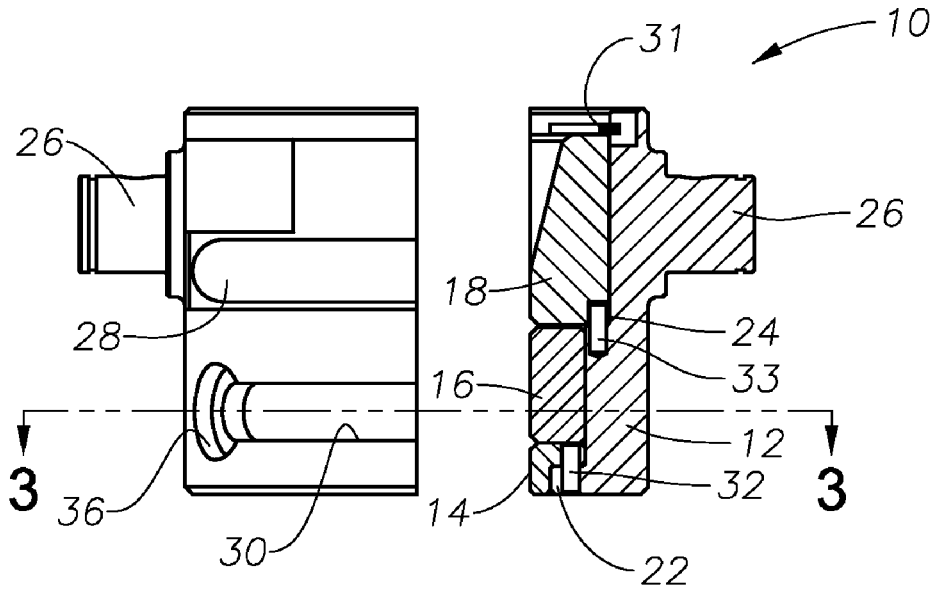
FIG. 2 shows a partial sectional view of the elevator of FIG. 1.

Referring now to FIGS. 1 and 2, elevator assembly 10 comprises body 12, bottom ring 14, door 16, top ring 18, and locking pin 20. FIG. 2 is a sectional view of elevator assembly 10 taken along section line A-A of FIG. 1. Body 12 comprises lower shoulder 22, upper shoulder 24, bail pins 26, handle 28, and locking slot 30. Bottom ring 14 and top ring are rotatably fixed relative to body 12 by pins 32 and 33, respectively. Locking pin 20 is coupled to door 16 and is guided by locking slot 30. Snap ring 31 engages body 12 and holds top ring 18, door 16, and bottom ring 14 within the body.

Body 12 has a substantially cylindrical shape having an opening 34 on one side. Bail pins 26 are arranged on opposite sides of body 12 for attaching to bails, or other lifting members. In certain embodiments, bail pins 26 may be replaced by lugs, lifting ears, or other means for connecting elevator 10 to a lifting appliance. Locking slot 30 extends through body 12 and includes counterbore 36 sized so as to interface with locking pin 20.

FIGS. 3 and 5 show a cross-section of elevator assembly 10, taken along section line 3-3 of FIG. 2. FIG. 3 shows elevator assembly 10 is shown in an open position wherein door opening 38 is aligned with body opening 34. In the open position, bushing 40 of locking pin 20 is retracted and rests against body 12. Referring now to FIG. 4, locking pin 20 comprises bushing 40, rod 42, bushing spring 44, lock button 46, and button spring 48. Bushing 40 comprises shoulder 50 and counterbore 52. Rod 42 comprises T-shaped flont end 54 that engages door 16 and flanged back end 56 that slidably engages lock button 46, such as with a dove-tail slot. Bushing spring 44 is disposed between shoulder 50 and back end 56 so as to bias bushing 40 toward front end 54 of rod 42. In order to move bushing 40 toward back end 56, lock button 46 must be centered so as to move past counterbore 52. Lock button 46 is biased to an offset position by button spring 48.

Door 16 is rotated to a closed position, as shown in FIG. 5, by moving locking pin 20 through slot 30 until locking pin 20 engages counterbore 36. The engaged locking pin is shown in FIG. 6. In the closed position, door 16 completely closes body opening 34 and locking pin 20 is disposed at the end of slot 30. Bushing 40 is urged into counterbore 36 by bushing spring 44. As bushing 40 moves into counterbore 36, lock button 46 enters bushing counterbore 52 and is urged to one side by button spring 48.

From the locked position the only way to unlock and rotate door 16 is to follow the steps described below. First, lock button 46 us centered within bushing 40. This allows bushing 40 to be pulled out of counterbore 36. Once bushing 40 is out of counterbore 36, door 16 can be rotated by moving locking pin 20 through slot 30 to the open position shown in FIG. 4.

Figure 7:
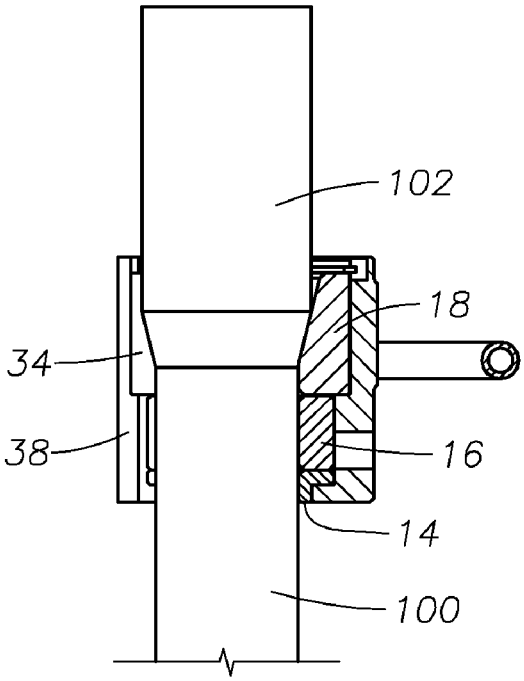
FIG. 7 shows a tubular member being received by an elevator constructed in accordance with embodiments of the invention.
Figure 8:
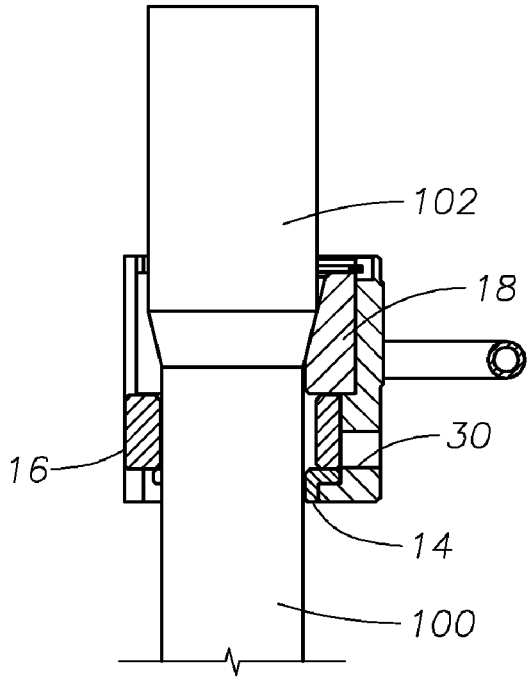
FIG. 8 shows a tubular member fully engaged by an elevator constructed in accordance with embodiments of the invention.
Figure 9:
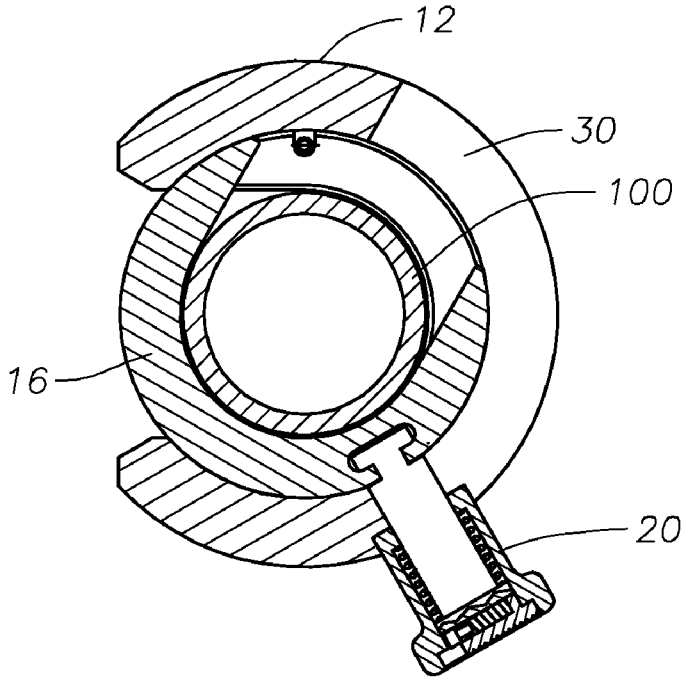
FIG. 9 shows a cross-sectional view of the engaged elevator of FIG. 8.

FIGS. 7-9 illustrate the engagement of a tubular member 100 with elevator assembly 10. As shown in FIG. 7, elevator assembly 10 is in the open position wherein door opening 38 is aligned with body opening 34. Tubular member 100 is inserted into openings 34, 38 such that elevator 10 is disposed close to tool joint 102. Elevator 10 may be attached to tubular member 100 when the tubular member is vertical, horizontal, or at any angle in between. Once tubular member 100 is received in elevator 10, locking pin 20 is moved through slot 30 such that door 16 rotates to capture the tubular member.

Once in the closed position, as shown in FIGS. 8 and 9, angled surface of top ring 18 engages the tapered shoulder of tool joint 102. Door 16 holds tubular member 100 in close engagement with top ring 18 and bottom ring 14. Thus, tubular member 100 is securely fastened within elevator 10 and ready to be lifted up. Once the handling of tubular member 100 is completed, door 16 is rotated back to the open position of FIG. 7 and elevator 10 can be removed from the tubular member.

As can be seen in FIG. 8, the relationship between top ring 18, door 16, and bottom ring 14 and tubular member 100 is critical to the performance of elevator 10. As the diameter and type of tubular member changes, one or more of bottom ring 14, door 16, and top ring 18 may have to be changed so as to properly engage pipes with different diameters or tool joint shoulders. Many of the other components of elevator 10, such as body 12 and locking pin 20 may be used for a wide range of pipe sizes without replacement. Thus, elevator 10 may be designed to allow for simple assembly and disassembly.

Referring back to FIGS. 2 and 3, elevator 10 can be disassembled by first removing snap ring 31, allowing top ring 18 to be removed from body. Door 16 can then be lifted up through body 12. As door 16 is lifted locking pin 20 will slide out of the T-shaped slot in the door, thus allowing the locking pin to be removed from slot 30. After door 16 is removed, bottom ring 14 can then be removed from body 12.

In the above described embodiments, locking pin 20 is used to manually open and close elevator 10. In other embodiments, the door could have gear teeth cut on its outside surface and the locking pin could be replace by pinion and hydraulic motor which would rotate the door. The hydraulically actuated elevator may find particular usefulness in allowing for remote control of the elevator and for larger elevator sizes where manual operation would be difficult.

While preferred embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. For example, elevators capable of handling a wide array of sizes and tubular members can be constructed in accordance with the embodiments discussed herein. Accordingly, the scope of protection is not limited to the embodiments described herein, but is only limited by the claims that follow, the scope of which shall include all equivalents of the subject matter of the claims.

What is claimed is:

1. An elevator comprising:

a body having a longitudinal axis therethrough, wherein said body is operable to at least partially surround and support a tubular member aligned with the longitudinal axis;

a longitudinal opening through said body, wherein said opening is sized so as to allow the tubular member to pass therethrough;

a door disposed coaxially within the body and rotatable about the longitudinal axis of the body, wherein said door has a closed position wherein the tubular member is retained within said body and an opened position wherein the tubular member can pass through the longitudinal opening;

a circumferential slot extending radially completely through said body; and a pin disposed through said slot and engaged with said door, wherein the circumferential movement of said pin through said slot controls the position of said door.

2. The elevator of claim 1 further comprising a top ring disposed within said body, wherein said top ring comprises a support surface that engages a shoulder disposed on the tubular member.

3. The elevator of claim 2 further comprising a bottom ring disposed within said body, wherein said door is disposed vertically between said top ring and said bottom ring.

4. The elevator of claim 3 wherein said top ring, said bottom ring, and said door are removable from said body.

5. The elevator of claim 1 further comprising a locking member that fixes the position of said pin relative to said slot when said door is in the closed position.

6. The elevator of claim 1 wherein said pin further comprises an axially moveable bushing disposed thereon, wherein the bushing engages a counterbore formed in said slot when said door is in the closed position.

7. The elevator of claim 6 further comprising a bushing lock that prevents movement of the bushing relative to said pin when the bushing is engaged with the counterbore.

8. A pipe elevator comprising:

a body having a longitudinal axis therethrough;

a top ring disposed within said body;

a bottom ring disposed within said body, wherein said top ring and bottom ring each have openings that are aligned with an opening through said body;

a door disposed between said top ring and said bottom ring, wherein said door is rotatable about the longitudinal axis of the body between a closed position, wherein said door prevents a pipe member from moving through the opening through said body, and an opened position, wherein said door allows the pipe member to pass through the opening through said body.

9. The pipe elevator of claim 8 wherein said top ring, said bottom ring, and said door are removable from said body.

10. The pipe elevator of claim 8 further comprising:

a circumferential slot disposed through said body; and a pin disposed through said slot and engaged with said door, wherein the movement of said pin through said slot controls the position of said door.

11. The pipe elevator of claim 10 further comprising a locking member that fixes the position of said pin relative to said slot when said door is in the closed position.

12. The pipe elevator of claim 10 wherein said pin further comprises an axially moveable bushing disposed thereon, wherein the bushing engages a counterbore formed in said slot when said door is in the closed position.

13. The pipe elevator of claim 12 further comprising a bushing lock that prevents movement of the bushing relative to said pin when the bushing is engaged with the counterbore.

* * * * *